US008909121B2

(12) United States Patent
Nishisaka et al.

(10) Patent No.: US 8,909,121 B2
(45) Date of Patent: Dec. 9, 2014

(54) IMAGE FORMING APPARATUS

(71) Applicant: Konica Minolta, Inc., Tokyo (JP)

(72) Inventors: Yusuke Nishisaka, Tokyo (JP); Satoshi Nishida, Saitama (JP); Hideo Yamaki, Tokyo (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/896,880

(22) Filed: May 17, 2013

(65) Prior Publication Data

US 2013/0315612 A1 Nov. 28, 2013

(30) Foreign Application Priority Data

May 24, 2012 (JP) ..... 2012-118926

(51) Int. Cl.
*G03G 21/00* (2006.01)
*G03G 15/16* (2006.01)

(52) U.S. Cl.
CPC ..... *G03G 15/16* (2013.01); *G03G 15/1605* (2013.01)
USPC ..... 399/345; 399/66; 399/121; 399/313

(58) Field of Classification Search
CPC ..... G03G 15/16; G03G 15/1605; G03G 15/1615; G03G 15/1675; G03G 15/1685
USPC ..... 399/45, 66, 121, 313, 345
See application file for complete search history.

(56) References Cited

U.S. PATENT DOCUMENTS 8,036,550 B2 * 10/2011 Minbu ..... 399/45
8,515,311 B2 * 8/2013 Kishi ..... 399/121

FOREIGN PATENT DOCUMENTS

JP 08087156 A 4/1996
JP 2010-2838 A 1/2010
JP 2010-139603 A 6/2010

OTHER PUBLICATIONS

Japanese Office Action "Notice of Reasons for Rejection" in relation to Japanese Patent Application Number: 2012-118926, Mailing Mate: Jul. 22, 2014, with English translation.

* cited by examiner

*Primary Examiner* — Hoang Ngo
(74) *Attorney, Agent, or Firm* — Cantor Colburn LLP

(57) ABSTRACT

An image forming apparatus includes: a transfer belt that is stretched on a plurality of support rollers including a backup roller in a loop-like manner and has an outer surface for carrying thereon a toner image; a transfer roller that is brought into pressurized contact with the backup roller across the transfer belt and forms a transfer nip with the transfer belt; a restriction member that is placed upstream of a transfer nip in a sheet conveying direction so as to be switchable between a first state in which the restriction member is brought closer to an inner surface of the transfer belt and a second state in which a distance of the restriction member from the inner surface of the transfer belt is larger than that in the first state; and a control section that switches a state of the restriction member.

10 Claims, 7 Drawing Sheets

IMAGE FORMING APPARATUS

CROSS REFERENCE TO RELATED APPLICATIONS

This application is entitled to and claims the benefit of Japanese Patent Application No. 2012-118926, filed on May 24, 2012, the disclosure of which including the specification, drawings and abstract is incorporated herein by reference in its entirety.

BACKGROUND OF THE INVENTION

1. Field of the Invention

The present invention relates to an electrophotographic image forming apparatus, and more particularly, to an image forming apparatus with an intermediate transfer system that transfers a toner image carried on an intermediate transfer belt to a sheet.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization for fixing, whereby an image is formed on the sheet.

In recent years, image forming apparatuses are required to form high-quality images on a wide variety of sheets. In response to such a need, an intermediate transfer system using an intermediate transferrer such as an intermediate transfer belt has become mainstream. In the intermediate transfer system, respective toner images of yellow (Y), magenta (M), cyan (C), and black (K) formed on photoconductor drums are transferred (primarily transferred) to the intermediate transferrer, and the toner images of the four colors are superimposed on each other on the intermediate transferrer. Then, the resultant image is transferred (secondarily transferred) to a sheet.

FIG. 1 illustrates a configuration in the vicinity of a secondary transfer section that transfers a toner image carried on an intermediate transfer belt to a sheet.

As illustrated in FIG. 1, intermediate transfer belt 421 is stretched on a plurality of support rollers 423 including backup roller 423A. Secondary transfer roller 431A is brought into pressurized contact with backup roller 423A, whereby transfer nip N is formed. Sheet S is caused to pass through transfer nip N, whereby a toner image carried on intermediate transfer belt 421 is transferred to sheet S.

In general, intermediate transfer belt 421 enters transfer nip N so as to be inclined to the line connecting between the shaft centers of backup roller 423A and secondary transfer roller 431A. Upstream of transfer nip N in the sheet conveying direction, sheet S is pressed against intermediate transfer belt 421, to be thereby conveyed while being curved along secondary transfer roller 431A. Sheet S is thus nipped (so-called pre-nipped) also upstream of transfer nip N in the sheet conveying direction, and hence the transfer performance is improved.

When such an image forming apparatus as described above forms an image on sheet S having a high stiffness, such as cardboard, electric discharge occurs in the vicinity of the entrance of transfer nip N, and erroneous transfer of transfer dust and the like may occur. Specifically, when the rear end of sheet S enters transfer nip N, the rear end of sheet S pushes up intermediate transfer belt 421 (so-called rear-end flick occurs), whereby a gap is formed between sheet S and intermediate transfer belt 421. The gap thus formed causes electric discharge (see FIG. 2).

For example, Japanese Patent Application Laid-Open No. 2010-139603 discloses the following technique for preventing electric discharge in the vicinity of the entrance of a transfer nip. That is, at the timing at which the rear end of a sheet comes out of a guide member, an intermediate transfer belt is displaced upstream of transfer nip N in the sheet conveying direction, whereby the impact when the sheet collides against the intermediate transfer belt is reduced.

Japanese Patent Application Laid-Open No. 2010-2838 discloses that a sheet is conveyed substantially perpendicularly to the line connecting between the shaft center of a secondary transfer roller and the shaft center of a counter roller, and an electrode member is placed inside of an intermediate transfer belt, whereby an electric field that is formed in a gap in the same direction as that of a transfer electric field is weakened.

Unfortunately, according to the image forming apparatus disclosed in Japanese Patent Application Laid-Open No. 2010-139603, although the impact when the sheet collides against the intermediate transfer belt is reduced, the intermediate transfer belt bends inwardly when the rear end of the sheet enters the transfer nip, so that a non-negligible gap is formed. Hence, the occurrence of electric discharge cannot be reliably prevented. Further, if the intermediate transfer belt is displaced, the nip width between the intermediate transfer belt and a secondary transfer roller unfavorably changes between before and after the displacement. Hence, color deviation, tone deviation, and the like may occur in a formed image.

The image forming apparatus disclosed in Japanese Patent Application Laid-Open No. 2010-2838 has a configuration in which the sheet is conveyed substantially perpendicularly to the line connecting between the shaft center of the secondary transfer roller and the shaft center of the counter roller, that is, a configuration in which a rear-end flick of sheet on the intermediate transfer belt does not occur. Hence, Japanese Patent Application Laid-Open No. 2010-2838 does not refer to a gap formed by the rear-end flick.

SUMMARY OF THE INVENTION

An object of the present invention is to provide an image forming apparatus that can reduce the occurrence of electric discharge in the vicinity of the entrance of a transfer nip and thus can prevent a decrease in image quality deriving from the electric discharge.

To achieve at least one of the abovementioned objects, an image forming apparatus reflecting one aspect of the present invention includes:

a plurality of support rollers including a backup roller;

a transfer belt that is stretched on the plurality of support rollers in a loop-like manner and has an outer surface for carrying thereon a toner image; and a transfer roller that is brought into pressurized contact with the backup roller across the transfer belt and forms a transfer nip with the transfer belt, the image forming apparatus configured to allow a sheet to pass through the transfer nip to thereby transfer the toner image carried on the transfer belt to the sheet, the image forming apparatus comprising:

a restriction member that is placed upstream of the transfer nip in a sheet conveying direction so as to be switchable between a first state in which the restriction member is brought closer to an inner surface of the transfer belt and a second state in which a distance of the restriction member from the inner surface of the transfer belt is larger than that in the first state; and a control section that switches a state of the restriction member to one of the first state and the second state in accordance with the sheet used for image formation.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described in detail with reference to the accompanying drawings.

Figure 1:
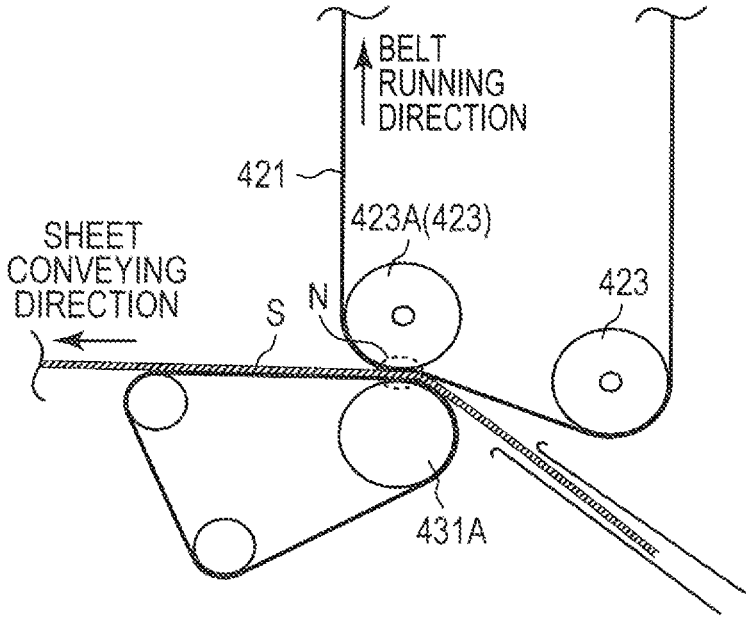
FIG. 1 illustrates a configuration in the vicinity of a secondary transfer section of a conventional image forming apparatus.
Figure 2:
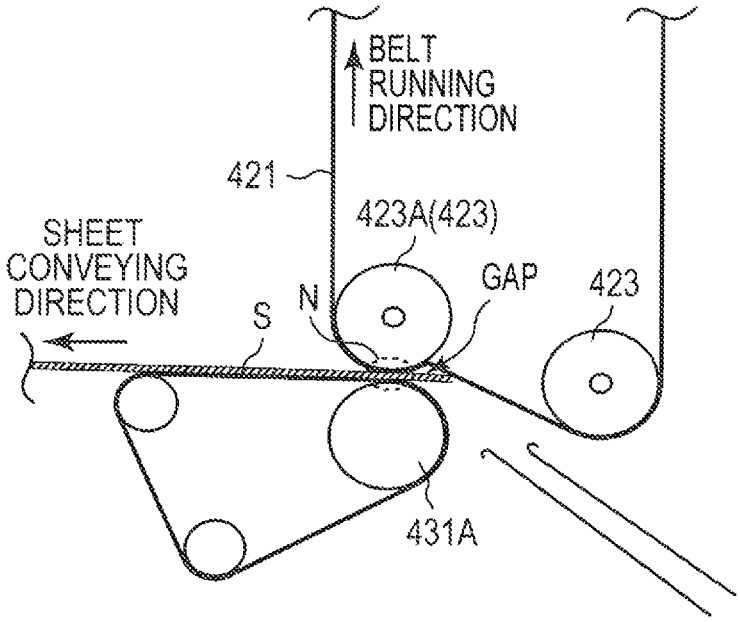
FIG. 2 illustrates a rear-end flick in the conventional image forming apparatus.
Figure 3:
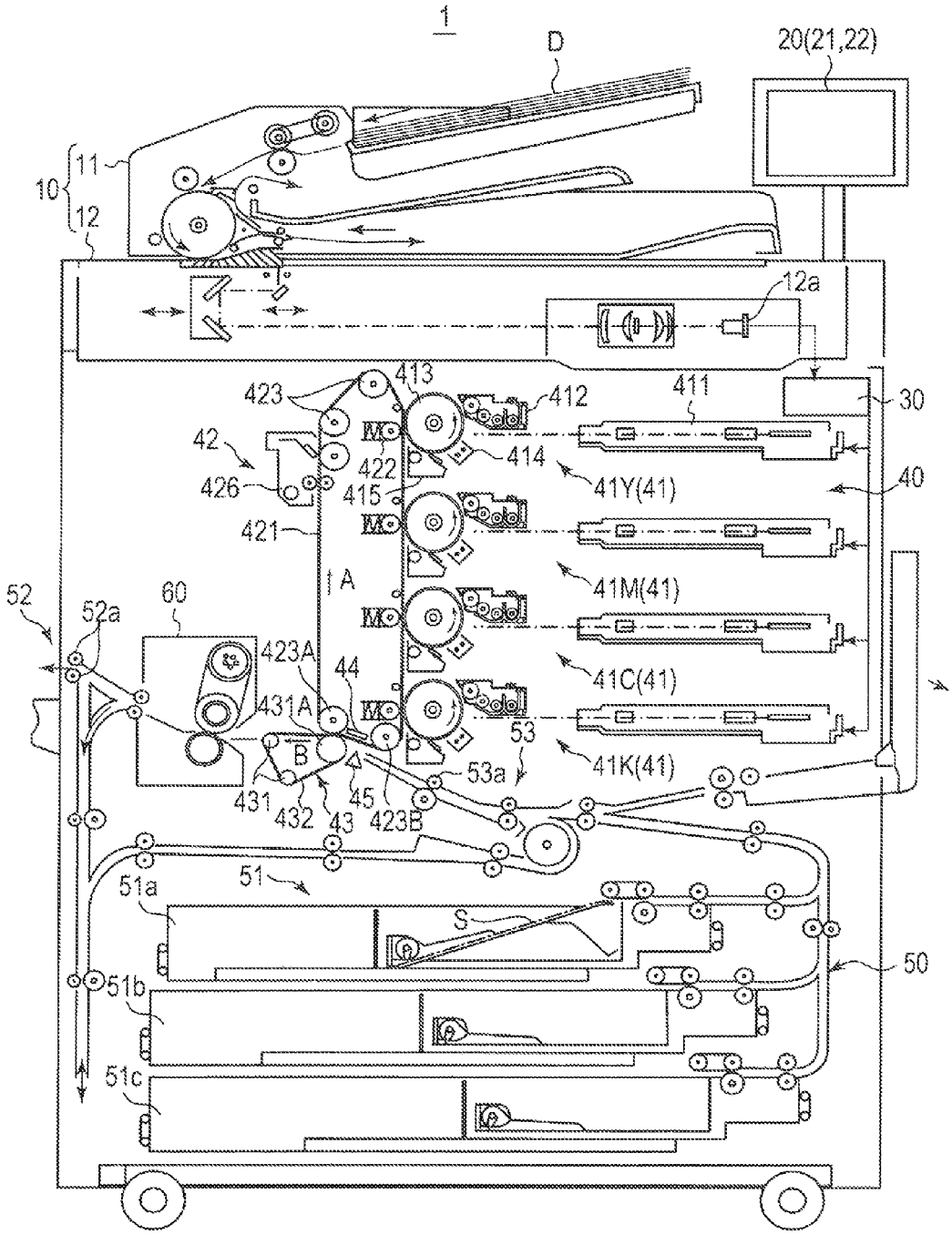
FIG. 3 schematically illustrates an overall configuration of an image forming apparatus according to an embodiment of the present invention.
Figure 4:
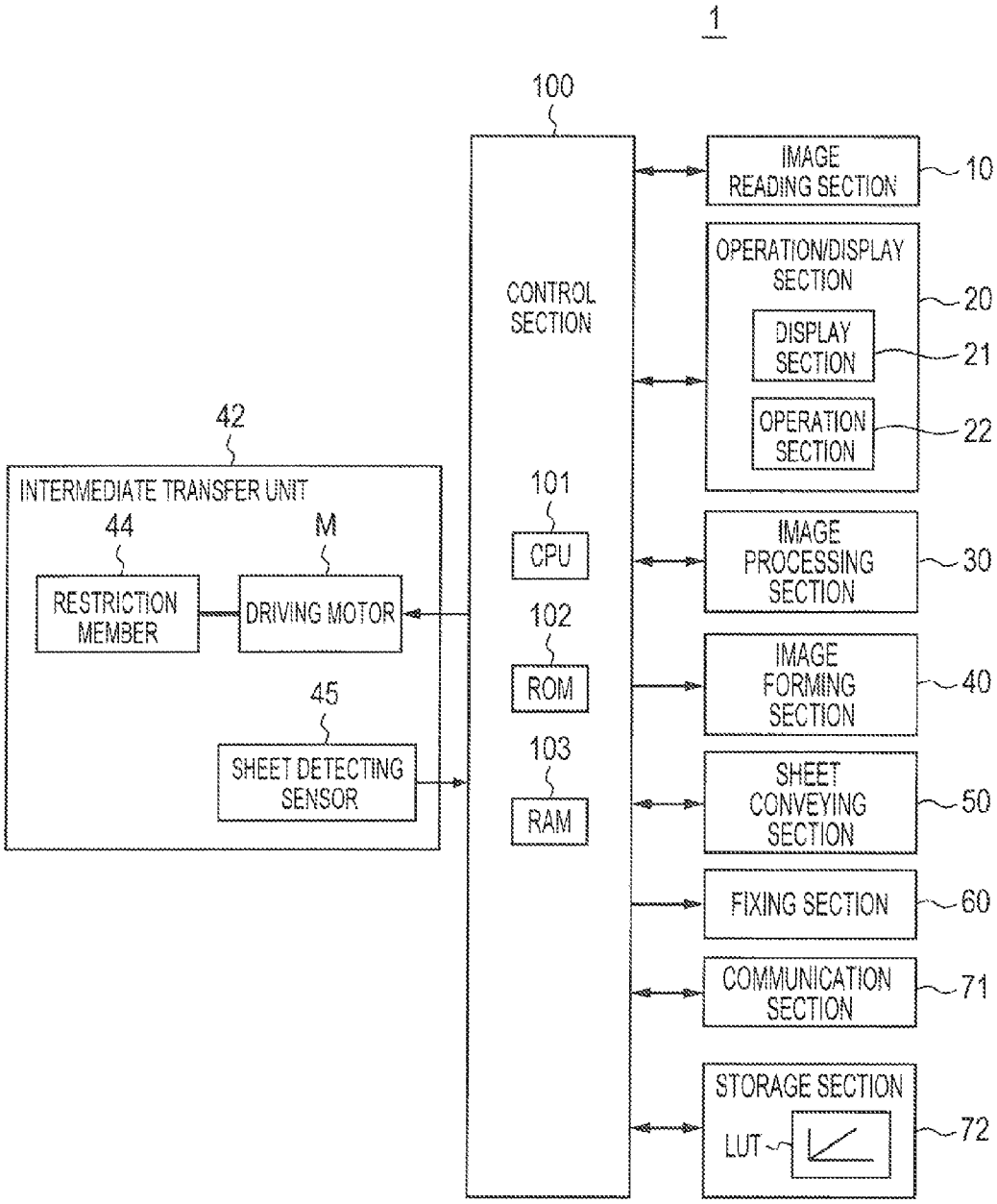
FIG. 4 illustrates a principal part of a control system of the image forming apparatus according to the embodiment.

FIG. 3 schematically illustrates an overall configuration of image forming apparatus 1 according to the embodiment of the present invention. FIG. 4 illustrates a principal part of a control system of image forming apparatus 1 according to the embodiment.

Image forming apparatus 1 illustrated in FIGS. 3 and 4 is a color image forming apparatus with an intermediate transfer system using electrophotographic process technology. That is, image forming apparatus 1 transfers (primarily transfers) respective toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondarily transfers) the resultant image to sheet S, to thereby form an image.

A tandem system is adopted for image forming apparatus 1. In the tandem system, respective photoconductor drums 413 corresponding to the four colors of YMCK are placed in series in the running direction of intermediate transfer belt 421, and the toner images of the four colors are sequentially transferred to intermediate transfer belt 421 in one cycle.

As illustrated in FIGS. 3 and 4, image forming apparatus 1 includes image reading section 10, operation/display section 20, image processing section 30, image forming section 40, sheet conveying section 50, fixing section 60, and control section 100.

Control section 100 includes central processing unit (CPU) 101, read only memory (ROM) 102, and random access memory (RAM) 103. CPU 101 reads a program suited to processing contents out of ROM 102, develops the program in RAM 103, and integrally controls an operation of each block of image forming apparatus 1 in cooperation with the developed program. At this time, CPU 101 refers to various pieces of data stored in storage section 72. Storage section 72 is configured by, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is configured by, for example, a communication control card such as a LAN card.

Control section 100 controls restriction member 44 (to be described later) to move in accordance with the type and the like of sheet S at the time of image formation.

Image reading section 10 includes auto document feeder (ADF) 11, document image scanner 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of reading results provided by document image scanner 12. Image processing section 30 performs predetermined image processing on the input image data.

Operation/display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings, on the input image data, and the like. For example, image processing section 30 performs toner correction on the basis of toner correction data (toner correction table), under the control of control section 100. In addition to the toner correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and secondary transfer unit 43, and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 3, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, and drum cleaning device 415.

Photoconductor drum 413 is, for example, a negatively-charged-type organic photoconductor (OPC) formed by sequentially laminating an under coat layer (UCL), a charge generation layer (CGL), and a charge transport layer (CTL) on the circumferential surface of a conductive cylindrical body (elementary tube) that is made of aluminum and has a drum diameter of 80 mm.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drum 413, whereby photoconductor drum 413 is rotated at a constant circumferential speed.

Charging device 414 evenly negatively charges the surface of photoconductor drum 413.

Exposure device 411 is configured by, for example, a semiconductor laser, and irradiates photoconductor drum 413 with laser light corresponding to the image of each color component. Because the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 due to a difference in potential from its surroundings.

Developing device 412 is of, for example, a two-component development system. Developing device 412 attaches the toner of each color component to the surface of photoconductor drum 413, and thus visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after primary transfer.

Intermediate transfer unit 42 includes intermediate transfer belt 421 that functions as an intermediate transferrer, a plurality of support rollers 423 including backup roller 423A, and belt cleaning device 426.

Intermediate transfer belt 421 is configured by an endless belt, and is stretched on the plurality of support rollers 423 in a loop-like manner. Support roller 423B upstream of backup roller 423A in the belt running direction is located at a position lower than the position of backup roller 423A.

At least one of the plurality of support rollers 423 is configured by a driving roller, and the others are each configured by a driven roller. Support roller 423 that functions as the driving roller rotates, whereby intermediate transfer belt 421 runs at a constant speed in the arrow A direction. Intermediate transfer belt 421 is brought into pressurized contact with photoconductor drums 413 by primary transfer rollers 422, whereby the toner images of the four colors are primarily transferred to intermediate transfer belt 421 so as to be sequentially superimposed on each other.

Secondary transfer unit 43 includes secondary transfer belt 432 and a plurality of support rollers 431 including secondary transfer roller 431A.

Secondary transfer belt 432 is configured by an endless belt, and is stretched on the plurality of support rollers 431 in a loop-like manner. At least one of the plurality of support rollers 431 is configured by a driving roller, and the others are each configured by a driven roller. Support roller 431 that functions as the driving roller rotates, whereby secondary transfer belt 432 runs at a constant speed in the arrow B direction.

Secondary transfer roller 431A is brought into pressurized contact with backup roller 423A across intermediate transfer belt 421 and secondary transfer belt 432, whereby transfer nip N is formed. When sheet S passes through transfer nip N, the toner images carried on intermediate transfer belt 421 are secondarily transferred to sheet S. Specifically, a voltage (transfer bias) having a polarity opposite to that of the toner is applied to secondary transfer roller 431A, whereby the toner images are electrostatically transferred to sheet S. Sheet S to which the toner images have been transferred is conveyed to fixing section 60 by secondary transfer belt 432.

Because support roller 423B upstream of backup roller 423A in the belt running direction is located at a position lower than the position of backup roller 423A, intermediate transfer belt 421 enters transfer nip N obliquely from below. Upstream of transfer nip N in the sheet conveying direction, sheet S is pressed against intermediate transfer belt 421, to be thereby conveyed while being curved along secondary transfer roller 431A. Accordingly, sheet S is nipped (so-called pre-nipped) also upstream of transfer nip N, and hence the transfer performance is improved.

Belt cleaning device 426 includes a belt cleaning blade that is brought into sliding contact with the surface of intermediate transfer belt 421, and removes residual toner that remains on the surface of intermediate transfer belt 421 after secondary transfer.

Fixing section 60 heats and pressurizes sheet S conveyed thereto at its fixing nip, to thereby fix the toner images to sheet S. Fixing section 60 may include an air separation unit that blows air to thereby separate sheet S from a member on the fixing side (for example, a fixing belt) or a support member on the rear side (for example, a pressure roller).

Sheet conveying section 50 includes sheet feed section 51, sheet ejection section 52, and conveyance route section 53.

Three sheet feed tray units 51*a* to 51*c* included in sheet feed section 51 house sheets S (standard sheets, special sheets)

discriminated on the basis of the basis weight, the size, and the like, for each type set in advance.

Conveyance route section 53 includes a plurality of paired conveyance rollers such as paired sheet stop rollers 53*a*. Sheets S housed in sheet feed tray units 51*a* to 51*c* are send out one by one from the topmost sheet, and are conveyed to image forming section 40 by conveyance route section 53. At this time, a sheet stop roller section including paired sheet stop rollers 53*a* corrects the inclination of sheet S fed thereto, and adjusts conveyance timing thereof.

Then, image forming section 40 collectively secondarily transfers the toner images on intermediate transfer belt 421 to one surface of sheet S, and fixing section 60 performs a fixing process thereon. Sheet S on which an image has been formed is ejected to the outside of the apparatus by sheet ejection section 52 including ejection rollers 52*a*.

As described above, image forming apparatus 1 includes: the plurality of support rollers 423 including backup roller 423A; intermediate transfer belt 421 (transfer belt) that is stretched on the plurality of support rollers 423 in a loop-like manner and has an outer surface carrying the toner images; and secondary transfer roller 431A (transfer roller) that is brought into pressurized contact with backup roller 423A across intermediate transfer belt 421 and forms transfer nip N with intermediate transfer belt 421. Then, image forming apparatus 1 causes sheet S to pass through transfer nip N, to thereby secondarily transfer the toner images carried on intermediate transfer belt 421 to sheet S.

In the present embodiment, restriction member 44 is further placed in the loop of intermediate transfer belt 421, in order to restrict intermediate transfer belt 421 from bending inwardly.

Figure 5:
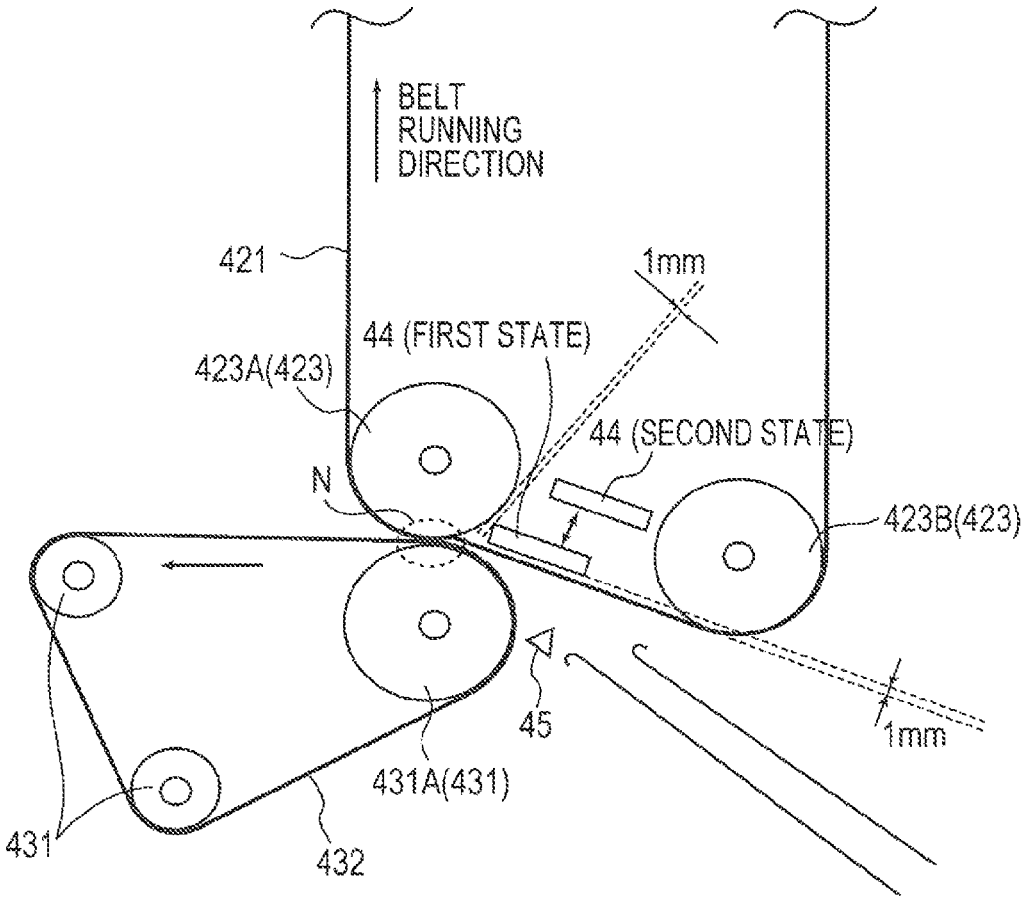
FIG. 5 illustrates a configuration in the vicinity of a secondary transfer section of the image forming apparatus according to the embodiment.

FIG. 5 illustrates intermediate transfer unit 42 and secondary transfer unit 43 in the vicinity of a secondary transfer section (transfer nip N).

As illustrated in FIG. 5, restriction member 44 is placed in the loop of intermediate transfer belt 421, upstream of transfer nip N in the sheet conveying direction (in the vicinity of the entrance of transfer nip N). The vicinity of the entrance of transfer nip N refers to a region in which rear-end flick of sheet on intermediate transfer belt 421 may occur, for example, a region ranging 50 mm from the entrance of transfer nip N to the upstream side.

Restriction member 44 is switchable between a first state (close state) and a second state (retracted state). In the first state, restriction member 44 is brought closer to the inner surface of intermediate transfer belt 421. In the second state, the distance of restriction member 44 from the inner surface of intermediate transfer belt 421 is larger than that in the first state. Restriction member 44 is connected to driving motor M (see FIG. 4) through, for example, a power transmission mechanism (not shown in the drawings) including a driving shaft and an eccentric cam. Control section 100 drives driving motor M, whereby the state of restriction member 44 is switched to the first state or the second state. Specifically, restriction member 44 is selectively switched to the first state or the second state in accordance with the basis weight and the stiffness of sheet S used for image formation.

The first state refers to a state that can prevent the so-called rear-end flick, in which intermediate transfer belt 421 is pushed up immediately before the rear end of sheet S enters transfer nip N. In the first state, restriction member 44 is spaced apart (for example, 1 mm) from the inner surface of intermediate transfer belt 421 so as not to come into contact therewith even if intermediate transfer belt 421 vibrates to some extent. This serves not to prevent normal running of intermediate transfer belt 421. Similarly, it is desirable that restriction member 44 be spaced apart (for example, 1 mm) also from backup roller 423A.

The second state may be a state in which restriction member 44 is certain not to come into contact with intermediate transfer belt 421, backup roller 423A, and support roller 423, that is, not to prevent operations of the other members.

It is preferable that restriction member 44 be formed into a tabular shape (having a thickness of, for example, 2 mm) that extends in the width direction of intermediate transfer belt 421. If restriction member 44 is formed into such a tabular shape, a retraction region for bringing restriction member 44 into the second state can be secured more easily. Further, in the first state, restriction member 44 can be brought closer to transfer nip N more easily, and hence the occurrence of a rear-end flick of sheet on intermediate transfer belt 421 can be effectively prevented.

It is preferable that a portion of restriction member 44 that is opposed to intermediate transfer belt 421 be a smooth surface. With this configuration, when intermediate transfer belt 421 is pushed up by the rear end of sheet S, restriction member 44 comes into surface contact with intermediate transfer belt 421, and hence the occurrence of a gap can be effectively prevented. Further, when restriction member 44 comes into contact with intermediate transfer belt 421, damage to the inner surface of intermediate transfer belt 421 can be prevented.

It is preferable that the portion of restriction member 44 that is opposed to intermediate transfer belt 421 be subjected to surface treatment for improving the slidability on intermediate transfer belt 421. For example, a tape having low frictional properties (for example, Ultra Tape (produced by Sumitomo 3M Limited)) is attached to the smooth surface of restriction member 44. This can prevent restriction member 44 from coming into contact with running intermediate transfer belt 421 to damage the inner surface of intermediate transfer belt 421.

It is preferable that restriction member 44 be made of an insulating material. Examples of the insulating material for restriction member 44 include polyacetal (POM) having a resistivity of $10^{10}$ to $10^{15}$ Ω·m. If the insulation properties of restriction member 44 are low, a predetermined transfer electric field may be disturbed by restriction member 44, and the transfer performance may become lower. Accordingly, restriction member 44 is made of the insulating material, whereby an influence of restriction member 44 on the transfer electric field is reduced. As a result, a high-quality image can be formed.

It is preferable that restriction member 44 be placed over the entire region in the width direction of intermediate transfer belt 421. With this configuration, the occurrence of a rear-end flick of sheet on intermediate transfer belt 421 can be effectively prevented over the entire region in the width direction.

As illustrated in FIG. 5, sheet detecting sensor 45 that detects the presence or absence of sheet S is placed upstream of transfer nip N (for example, 50 mm from the entrance of transfer nip N to the upstream side). Sheet detecting sensor 45 is configured by, for example, a photosensor including a light emitting element and a light receiving element. Sheet detecting sensor 45 causes the light emitting element to emit light to sheet S, and causes the light receiving element to receive light reflected from sheet S, to thereby obtain a detection signal corresponding to the presence or absence of sheet S. Sheet detecting sensor 45 outputs the detection signal to control section 100. On the basis of the detection signal, it is determined whether or not the rear end of sheet S has reached the vicinity of the entrance of transfer nip N.

The state of restriction member 44 is switched from the second state to the first state at the timing at which the rear end of sheet S has reached the vicinity of the entrance of transfer nip N, that is, at the timing immediately before the occurrence of a rear-end flick. Specifically, control section 100 controls the state of restriction member 44 according to a flow chart shown in FIG. 6 (restriction position controlling process). The restriction position controlling process shown in FIG. 6 is implemented, for example, when control section 100 receives a signal giving an instruction for image formation (for example, a print job) and CPU 101 accordingly executes a predetermined program stored in ROM 102.

It is assumed that the initial state of restriction member 44 is the second state.

It is also assumed that the detection signal of sheet detecting sensor 45 is always inputted to control section 100. When sheet S is conveyed and the front end of sheet S passes through the detection position of sheet detecting sensor 45, sheet detecting sensor 45 outputs a detection signal indicating the presence of sheet S to control section 100. After that, when the rear end of sheet S passes through the detection position of sheet detecting sensor 45, sheet detecting sensor 45 outputs a detection signal indicating the absence of sheet S to control section 100.

Figure 6:
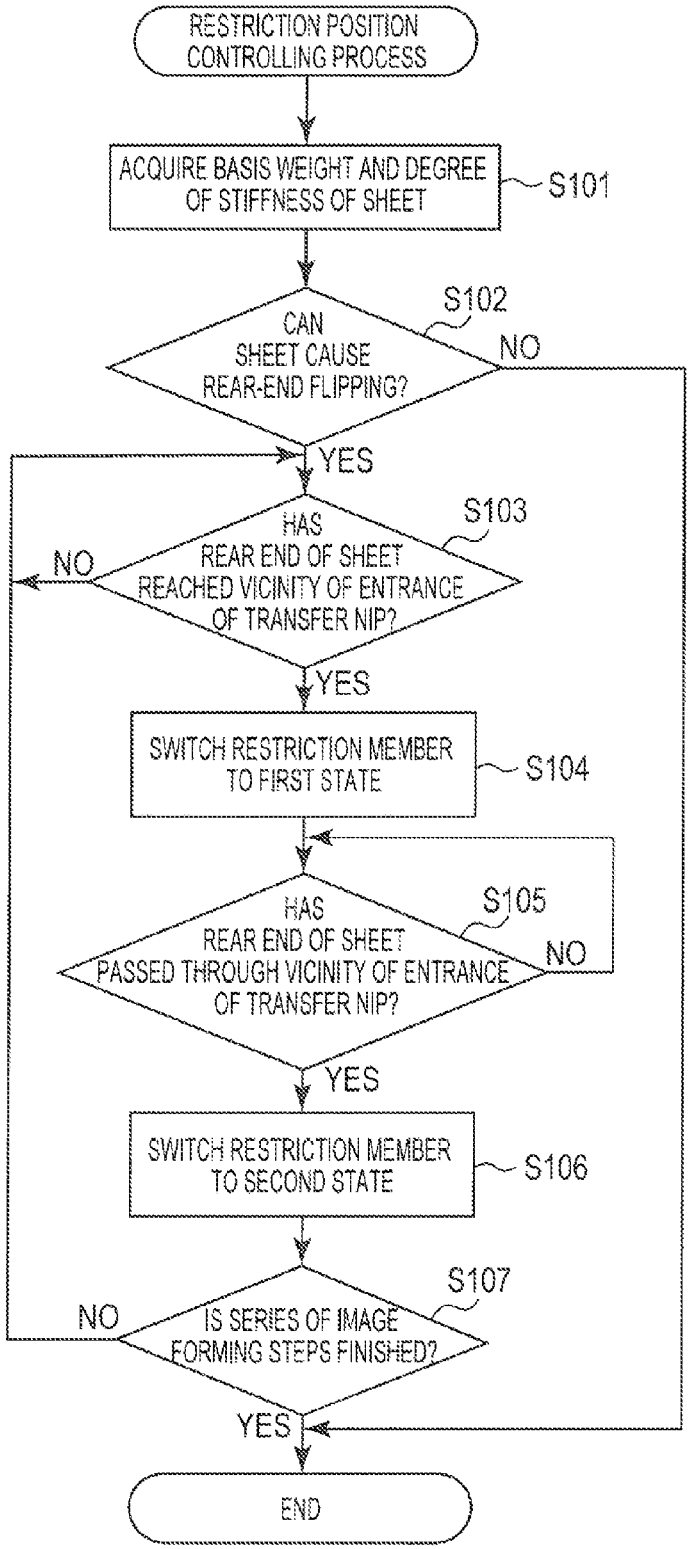
FIG. 6 is a flow chart showing a restriction position controlling process for controlling the state of a restriction member.

In Step S101 of FIG. 6, control section 100 acquires the basis weight and the stiffness of sheet S used for image formation. The basis weight and the stiffness of sheets S housed in each of three sheet feed tray units 51*a* to 51*c* are stored as sheet information in, for example, storage section 72. Control section 100 identifies sheet S used for image formation on the basis of the sheet information (or sheet feed tray information) contained in the print job, and acquires the basis weight and the stiffness of sheet S.

In Step S102, control section 100 determines whether or not sheet S used for image formation is a sheet that can cause a rear-end flick on intermediate transfer belt 421 (i.e., a sheet that is not easily curved). Control section 100 determines that sheet S is a sheet that can cause a rear-end flick, for example, if sheet S has a basis weight of 250 g/m$^2$ or more and a stiffness of 500 mN or more (which is measured using a stiffness tester produced by Kumagai Riki Kogyo Co., Ltd.).

At this time, look-up table LUT may be prepared which contains predetermined setting of whether or not a rear-end flick occurs for each combination of the basis weight and the stiffness of sheet S, and control section 100 may make the determination in Step S102 with reference to look-up table LUT. Alternatively, look-up table LUT may be used which contains predetermined setting of whether or not a rear-end flick occurs for each type of sheet S (for example, A4-size thin paper and B3-size cardboard).

If control section 100 determines that sheet S used for image formation is a sheet that can cause a rear-end flick on intermediate transfer belt 421, control section 100 moves to Step S103. If control section 100 determines that sheet S used for image formation is a sheet that does not cause a rear-end flick on intermediate transfer belt 421, the state of restriction member 44 does not need to be switched, and hence control section 100 ends the process.

If restriction member 44 is brought closer to intermediate transfer belt 421 even in the case where an image is formed on a sheet that does not cause a rear-end flick on intermediate transfer belt 421 (i.e., a sheet easy to curve), the possibility that restriction member 44 comes into contact with intermediate transfer belt 421 becomes higher. Accordingly, in the present embodiment, only in the case where an image is formed on a sheet that can cause a rear-end flick on intermediate transfer belt 421, the state of restriction member 44 is switched.

In Step S103, control section 100 determines whether or not the rear end of sheet S has reached the vicinity of the entrance of transfer nip N. Specifically, when control section 100 receives the detection signal indicating the absence of sheet S from sheet detecting sensor 45, control section 100 determines that the rear end of sheet S has reached the vicinity of the entrance of transfer nip N.

Figure 7:
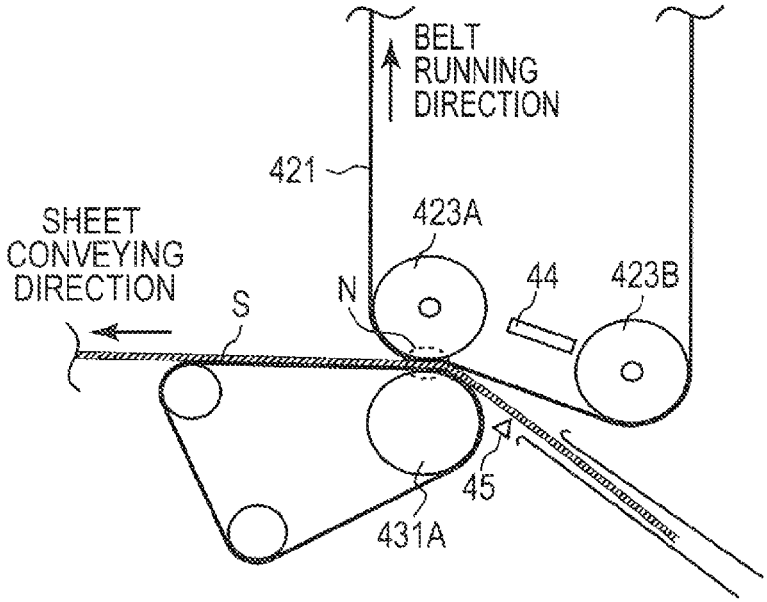
FIG. 7 illustrates the vicinity of the secondary transfer section when the restriction member is in a second state.

If control section 100 determines that the rear end of sheet S has reached the vicinity of the entrance of transfer nip N, control section 100 moves to Step S104. Until the rear end of sheet S has reached the vicinity of the entrance of transfer nip N, Sheet S is conveyed while being curved along secondary transfer roller 431A (see FIG. 7).

Figure 8:
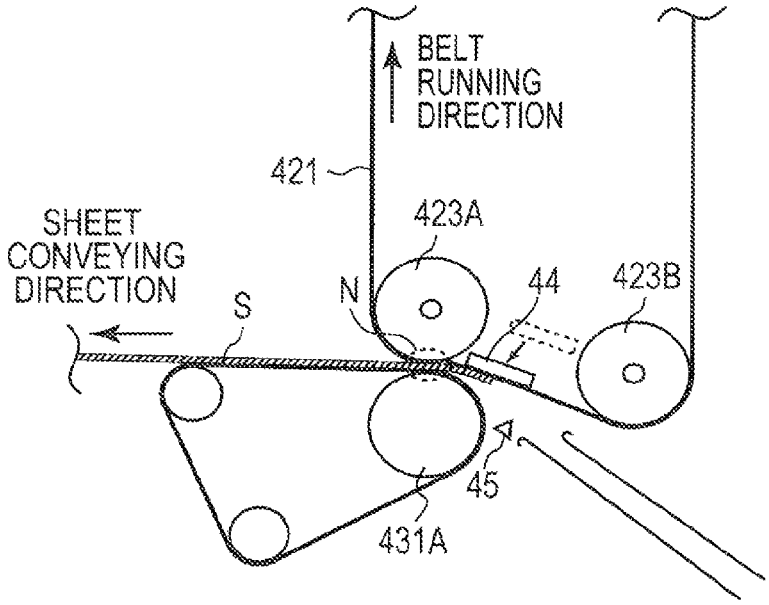
FIG. 8 illustrates the vicinity of the secondary transfer section when the restriction member is in a first state.

In Step S104, control section 100 switches the state of restriction member 44 from the second state to the first state (see FIG. 8). For example, control section 100 drives driving motor M, to thereby move restriction member 44 by a predetermined distance along a guide member (not shown in the drawings) and thus bring restriction member 44 into the first state.

In the first state, as illustrated in FIG. 8, restriction member 44 is placed along the inner surface of intermediate transfer belt 421 closely thereto, and hence intermediate transfer belt 421 is restricted from bending inwardly. That is, a rear-end flick on intermediate transfer belt 421 does not occur, and a gap is not formed between sheet S and intermediate transfer belt 421. Accordingly, the occurrence of electric discharge in the vicinity of the entrance of transfer nip N is reduced, and hence it is possible to prevent the occurrence of erroneous transfer deriving from the electric discharge and its associated decrease in image quality.

In Step S105, control section 100 determines whether or not the rear end of sheet S has passed through the vicinity of the entrance of transfer nip N. Specifically, control section 100 determines whether or not the rear end of sheet S has passed through the vicinity of the entrance of transfer nip N, on the basis of the time elapsed since the detection signal indicating the absence of sheet S is received from sheet detecting sensor 45.

If control section 100 determines that the rear end of sheet S has passed through the vicinity of the entrance of transfer nip N, control section 100 moves to Step S106.

In Step S106, control section 100 switches the state of restriction member 44 from the first state to the second state. That is, restriction member 44 is held in the first state while the rear end of sheet S is in the vicinity of the entrance of transfer nip N, and is held in the second state during the other period (normal period).

If restriction member 44 is brought closer to intermediate transfer belt 421 even during the normal period during which a rear-end flick of sheet on intermediate transfer belt 421 does not occur, the possibility that restriction member 44 comes into contact with intermediate transfer belt 421 becomes higher, and erroneous running of intermediate transfer belt 421 and damage thereto may occur. Accordingly, in the present embodiment, only during the period during which a rear-end flick of sheet on intermediate transfer belt 421 can occur, restriction member 44 is held in the first state.

In Step S107, control section 100 determines whether or not a series of image forming steps is finished. If control section 100 determines that the series of image forming steps is finished, control section 100 ends the restriction position controlling process. If control section 100 determines that the series of image forming steps is not finished, control section 100 moves back to Step S103, and continuously performs the restriction position controlling process.

The series of image forming steps here refers to a process of forming an image on a number of sheets, the number being set by the received signal giving an instruction for image formation (for example, the print job). That is, until the series of image forming steps on the set number of sheets is finished, control of switching the state of restriction member 44 is kept.

As described above, image forming apparatus 1 includes: restriction member 44 that is placed upstream of transfer nip N in the sheet conveying direction so as to be switchable between the first state in which restriction member 44 is brought closer to the inner surface of intermediate transfer belt 421 (transfer belt) and the second state in which the distance of restriction member 44 from the inner surface of intermediate transfer belt 421 is larger than that in the first state; and control section 100 that switches the state of restriction member 44 to the first state or the second state.

According to image forming apparatus 1, restriction member 44 can be placed along the inner surface of intermediate transfer belt 421 closely thereto, and hence intermediate transfer belt 421 is restricted from bending inwardly. That is, a rear-end flick of sheet on intermediate transfer belt 421 does not occur, and a gap is not formed between sheet S and intermediate transfer belt 421. Accordingly, the occurrence of electric discharge in the vicinity of the entrance of transfer nip N is reduced, and hence it is possible to prevent the occurrence of erroneous transfer deriving from the electric discharge and its associated decrease in image quality.

Restriction member 44 can be switched between the first state and the second state, and thus can be switched to the first state as needed. Accordingly, restriction member 44 can be effectively prevented from coming into contact with intermediate transfer belt 421 to cause erroneous running of intermediate transfer belt 421 and damage thereto.

Hereinabove, the invention made by the present inventors is specifically described by way of the embodiment. The present invention is not limited to the embodiment, and can be changed within a range not departing from the gist thereof.

Figure 9:
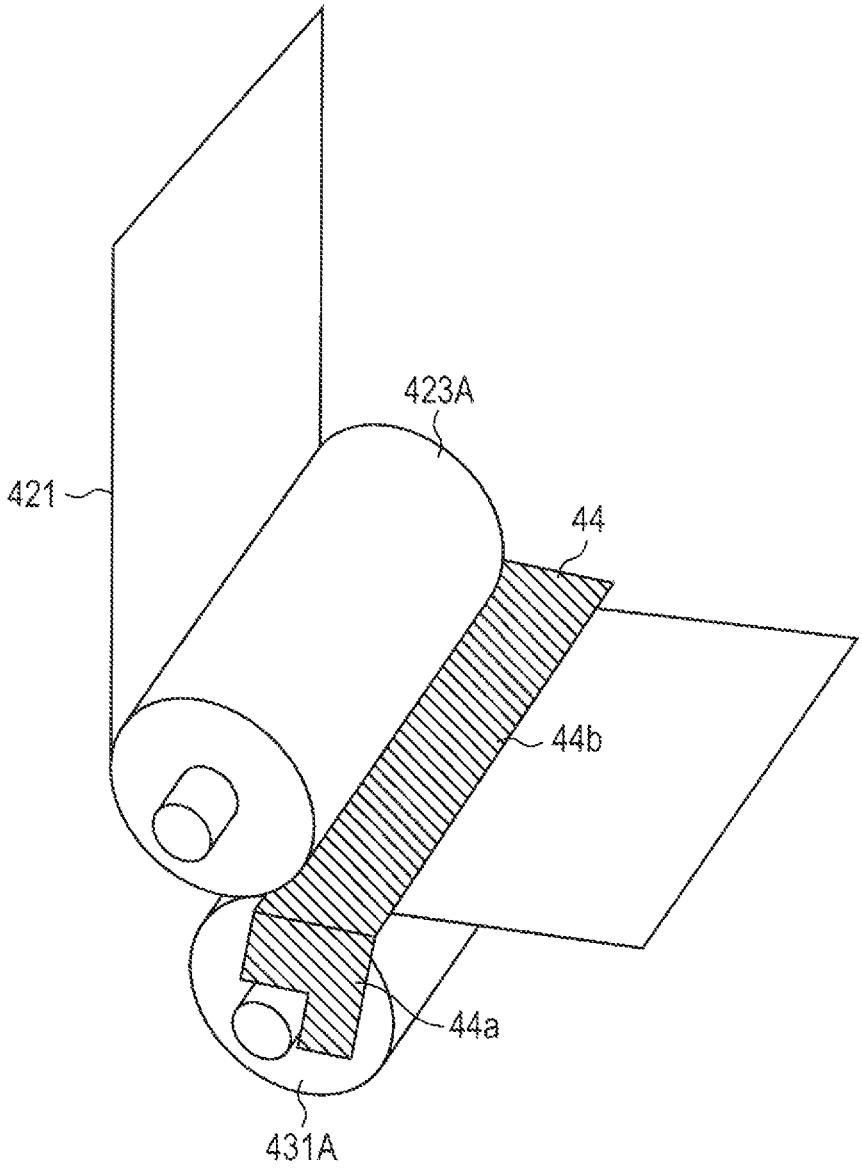
FIG. 9 illustrates the restriction member including a positioning section.

For example, restriction member 44 may include a positioning section that brings restriction member 44 into the first state. For example, as illustrated in FIG. 9, both the ends of restriction member 44 in the belt width direction are bent, and cut-out part 44*a* (positioning section) engaged with the shaft of secondary transfer roller 431A is formed. Cut-out part 44*a* of restriction member 44 abuts against secondary transfer roller 431A, whereby restriction member 44 cannot move beyond secondary transfer roller 431A. With this configuration, restriction member 44 is positioned with high precision in the state where planar part 44*b* thereof is spaced apart by a predetermined distance from the inner surface of intermediate transfer belt 421.

In this case, not the shaft of secondary transfer roller 431A but the shaft of backup roller 423A may be used as the reference against which the positioning section abuts. Further, in the case where secondary transfer roller 431A and backup roller 423A are different in the degree of hardness or where the nip pressure of transfer nip N is constant (for example, 70 N), the nip shape changes depending on its surrounding environments, and hence it is desirable to use, as the reference, one of secondary transfer roller 431A and backup roller 423A, the one having a higher degree of hardness.

In the case where an image is formed on sheet S that can cause a rear-end flick on intermediate transfer belt 421, if restriction member 44 is held in the first state only during the period during which the rear end of sheet S passes through the vicinity of the entrance of transfer nip N, the state of restriction member 44 is frequently changed. Degradation over time may be accelerated depending on the type of a driving mechanism of restriction member 44. In such a case, restriction member 44 may be continuously kept in the first state during the period of the series of image forming steps.

In the case where a rear-end flick of sheet on intermediate transfer belt 421 tends to occur in a central portion of intermediate transfer belt 421, restriction member 44 may be formed to be shorter than the width of intermediate transfer belt 421, and may be placed so as to be coincident with the central portion in the width direction of intermediate transfer belt 421.

The shape of restriction member 44 is not limited to the tabular shape, and may be any shape as long as a retraction region for the second state can be secured. For example, a portion of restriction member 44 that is opposed to transfer nip N may be contoured to fit the nip shape.

The embodiment disclosed above should be considered to be given as an example in all respects and not to limit the present invention. The scope of the present invention is defined by not the above description but the appended claims, and the present invention is intended to include all changes and modifications within the meaning of and range of equivalents of the appended claims.

What is claimed is:

1. An image forming apparatus including:

a plurality of support rollers including a backup roller;

a transfer belt that is stretched on the plurality of support rollers in a loop-like manner and has an outer surface for carrying thereon a toner image; and a transfer roller that is brought into pressurized contact with the backup roller across the transfer belt and forms a transfer nip with the transfer belt, the image forming apparatus configured to allow a sheet to pass through the transfer nip to thereby transfer the toner image carried on the transfer belt to the sheet, the image forming apparatus comprising:

a restriction member that is placed upstream of the transfer nip in a sheet conveying direction so as to be switchable between a first state in which the restriction member is brought closer to an inner surface of the transfer belt and a second state in which a distance of the restriction member from the inner surface of the transfer belt is larger than that in the first state; and a control section that switches a state of the restriction member to one of the first state and the second state in accordance with the sheet used for image formation.

2. The image forming apparatus according to claim 1, wherein the control section switches the state of the restriction member in accordance with a basis weight or stiffness of the sheet used for image formation.

3. The image forming apparatus according to claim 1, wherein the control section holds the state of the restriction member in the second state during a normal period, and the control section holds the state of the restriction member in the first state while a rear end of the sheet passes through a vicinity of an entrance of the transfer nip.

4. The image forming apparatus according to claim 1, wherein the restriction member is formed into a tabular shape that extends in a width direction of the transfer belt.

5. The image forming apparatus according to claim 1, wherein the restriction member has a smooth surface to be brought into surface contact with the inner surface of the transfer belt.

6. The image forming apparatus according to claim 1, wherein a contact surface of the restriction member with the transfer belt is subjected to surface treatment for improving slidability.

7. The image forming apparatus according to claim 1, wherein the restriction member is made of an insulating material.

8. The image forming apparatus according to claim 1, wherein the restriction member is placed over an entire region in a width direction of the transfer belt.

9. The image forming apparatus according to claim 1, wherein the restriction member is placed so as to be coincident with a central portion in a width direction of the transfer belt.

10. The image forming apparatus according to claim 1, wherein the restriction member includes a positioning section that brings the restriction member into the first state.

* * * * *